US011009019B2

(12) United States Patent
Kim et al.

(10) Patent No.: US 11,009,019 B2
(45) Date of Patent: May 18, 2021

(54) RECIPROCATING TYPE COMPRESSOR

(71) Applicant: LG ELECTRONICS INC., Seoul (KR)

(72) Inventors: Seungwook Kim, Seoul (KR); Wonseok Kang, Seoul (KR); Jongmok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 88 days.

(21) Appl. No.: 16/134,157

(22) Filed: Sep. 18, 2018

(65) Prior Publication Data

US 2019/0093649 A1 Mar. 28, 2019

(30) Foreign Application Priority Data

Sep. 25, 2017 (KR) ..... 10-2017-0123778

(51) Int. Cl.

| | |
|---|---|
| ***F04B 39/12*** | (2006.01) |
| ***F04B 39/00*** | (2006.01) |
| *F25B 31/02* | (2006.01) |
| *F04B 35/04* | (2006.01) |
| *F25B 1/02* | (2006.01) |

(52) U.S. Cl.

CPC ..... *F04B 39/127* (2013.01); *F04B 39/125* (2013.01); *F04B 35/04* (2013.01); *F04B 39/0005* (2013.01); *F04B 39/0094* (2013.01); *F25B 1/02* (2013.01); *F25B 31/023* (2013.01)

(58) Field of Classification Search

CPC ..... F04B 39/14; F04B 39/023; F04B 39/125; F04B 39/127; F04B 39/0094; F04B 39/121; F04B 39/122; F04B 39/12; F25B 1/02; F25B 31/02; F04C 2240/30; F04C 23/008; F16C 2362/52; Y10T 29/49236

USPC ..... 417/415, 902, 363, 360; 92/128; 62/469, 62/DIG. 2

See application file for complete search history.

(56) References Cited

U.S. PATENT DOCUMENTS 2,449,930 A * 9/1948 Davey ..... F04B 27/053 92/155
3,606,597 A * 9/1971 Russell ..... F04B 11/0016 417/542

(Continued)

FOREIGN PATENT DOCUMENTS

JP 2015-140737 8/2015
KR 20-1999-0039025 11/1999

(Continued)

OTHER PUBLICATIONS

International Search Report and Written Opinion dated Jan. 14, 2019 issued in PCT/KR2018/010944.

(Continued)

*Primary Examiner* — Dustin T Nguyen
(74) *Attorney, Agent, or Firm* — Ked & Associates LLP

(57) ABSTRACT

A reciprocating type compressor includes a crank shaft that is coupled to a rotor of a motor to transfer a rotational force, a piston that compresses a refrigerant while linearly moving within a cylinder of a compression portion, a connecting rod that connects the crank shaft to the piston to convert a rotational force of the crank shaft into a linear motion of the piston, and a cylinder boss integral body in which the cylinder and a boss that encloses the crank shaft are integrally formed at right angles to each other.

6 Claims, 7 Drawing Sheets

(56) References Cited

U.S. PATENT DOCUMENTS 3,844,688 A * 10/1974 Bulkley ..... F04B 39/04 417/313
4,033,707 A * 7/1977 Stutzman ..... F04B 39/12 417/312
4,566,865 A * 1/1986 Nishitsuji ..... F04B 39/127 248/300
4,802,861 A * 2/1989 Gaston ..... H01R 13/631 439/247
4,808,085 A * 2/1989 Nishitsuji ..... F04B 39/127 417/363
5,730,044 A * 3/1998 Oh ..... F04B 39/0005 92/128
6,599,103 B2 * 7/2003 Finnamore ..... F04B 27/0404 384/585
7,976,290 B2 * 7/2011 Wang ..... F04B 35/01 248/300
8,356,549 B2 * 1/2013 Iversen ..... F04B 39/122 92/128
9,074,589 B2 * 7/2015 Leu ..... F04B 35/04
9,109,588 B2 * 8/2015 Couto ..... F04B 39/122
2004/0253122 A1 * 12/2004 Grochowski ..... F04B 27/1045 417/360
2005/0265863 A1 12/2005 Akashi et al.
2006/0292022 A1 * 12/2006 An ..... F04B 39/1066 417/569
2009/0175743 A1 * 7/2009 Sakamoto ..... F04B 39/125 417/415
2012/0121443 A1 * 5/2012 Chou ..... F04B 35/04 417/297
2015/0288103 A1 * 10/2015 Sekino ..... G01L 19/0084 439/374

FOREIGN PATENT DOCUMENTS

KR 20-0224988 5/2001
KR 10-2005-0027221 3/2005
KR 10-1745471 6/2017

OTHER PUBLICATIONS

Korean Office Action dated Oct. 22, 2018 issued in KR Application No. 10-2017-0123778.

* cited by examiner

RECIPROCATING TYPE COMPRESSOR

CROSS-REFERENCE TO RELATED APPLICATION(S)

This application claims priority under 35 U.S.C. § 119 to Korean Application No. 10-2017-0123778, filed in Korea on Sep. 25, 2017, whose entire disclosure is herein incorporated by reference.

BACKGROUND

1. Field

A reciprocating type compressor is disclosed herein.

2. Background

A compressor may be applied to a vapor compression type refrigeration cycle such as a refrigerator or an air conditioner. Compressors may include a motor portion that generates power from an interior of a hermetic container and a compression portion that operates by receiving power from the motor portion.

Such a compressor may be divided into a reciprocating type, a rotary type, a vane type, and a scroll type, for example, depending on a method of compressing a refrigerant. Among them, the reciprocating type compressor may include a connecting rod coupled to a crank shaft of the motor portion and a piston coupled to the connecting rod so that a rotational force of the motor portion is converted into a linear motion of the piston.

For this purpose, one end of the connecting rod may be rotatably coupled to a pin of the crank shaft, and the other end of the connecting rod may be rotatably coupled to the piston. However, constituent elements of a cylinder provided so that the piston compresses the refrigerant while linearly reciprocating may be formed separately from each other, and thus performance may be degraded due to deformation of the cylinder that may occur when the cylinder is fastened.

Also, when a compressor is configured using a frame, it may be difficult to maintain perpendicularity between the cylinder and the crank shaft. The perpendicularity that is not maintained may cause friction or deformation of a mechanism and degrade performance of the compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
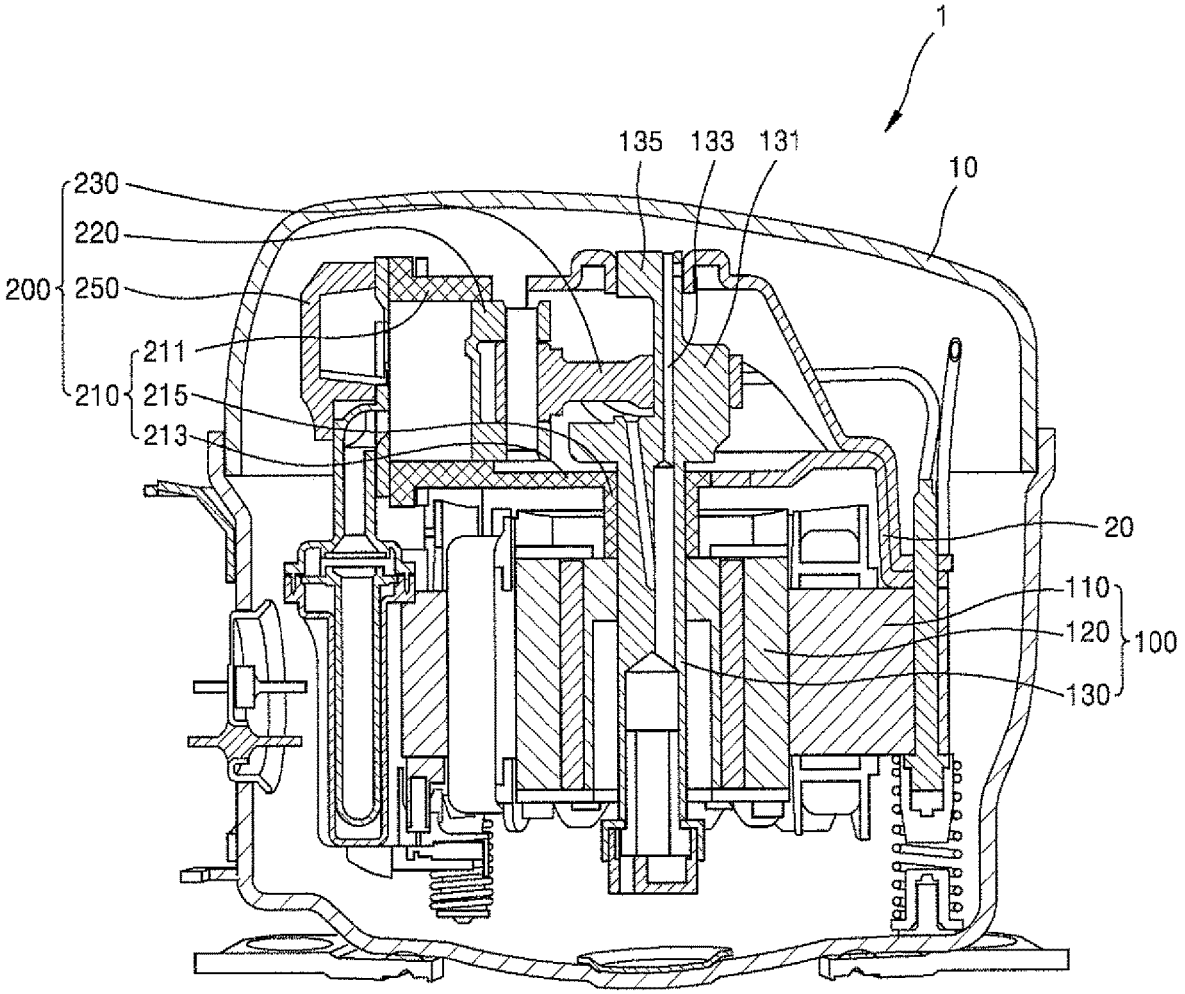
FIG. 1 is a schematic cross-sectional view illustrating a configuration of a reciprocating type compressor according to an embodiment.

In the present specification, a compressor may refer to a compressor applied to a vapor compression type refrigeration cycle such as a refrigerator or an air conditioner. FIG. 1 is a schematic cross-sectional view illustrating a configuration of a reciprocating type compressor according to an embodiment.

Referring to FIG. 1, a reciprocating type compressor 1 according to an embodiment may include a motor portion (or motor) 100 and a compression portion or device 200. The reciprocating type compressor 1 may include the motor portion 100 installed within a hermetic container 10 to perform forward and reverse rotation, and the compression portion 200 installed at an upper side of the motor portion 100 to compress a refrigerant by receiving a rotational force from the motor portion 100.

The motor portion 100 may use a constant-speed motor or an inverter motor capable of performing normal rotation and reverse rotation. The motor portion 100 may include a stator 110 supported by a frame 20 within the hermetic container 10, a rotor 120 rotatably installed at an inner side of the stator 110, and a crank shaft 130 that transfers a rotational force of the rotor 120 to the compression portion 200.

A pin portion (or pin) 131 of the crank shaft 130 may be coupled to a connecting rod 230. The connecting rod 230 that receives a rotational force of the crank shaft 130 may allow a piston 220 coupled to an opposite side of the crank shaft 130 to linearly move (that is, a linear reciprocating motion) within a cylinder 210.

An oil passage 133 may be formed within the crank shaft 130 in a longitudinal direction of the crank shaft. The compression portion 200 may include a cylinder 211 (hereinafter, referred to as "cylinder portion"), the piston 220, the connecting rod 230, and a head cover 250 including a valve assembly.

The cylinder portion 211 may include a compression space having a predetermined size that allows the piston 220 to linearly move, and the compression space may be provided at an upper side of the hermetic container 10. The cylinder portion 211 may be formed in a cylindrical shape.

Specifically, the cylinder portion 211 may be formed integrally with a boss 215 (hereinafter, referred to as a "boss portion") that encloses the crank shaft 130 while being at a right angle to the boss portion 215. The above-described structure is referred to as a cylinder boss integral body (or cylinder-boss body) 210.

The cylinder portion 211 and the boss portion 215 may be provided as a cylinder boss integral body 210 in which the cylinder portion 211 and the boss portion 215 are integrally formed at right angles to each other, thereby maintaining perpendicularity between the cylinder portion 211 and the boss portion 215. The piston 220 may compress the refrigerant while linearly moving within the compression space of the cylinder 211.

Figure 2:
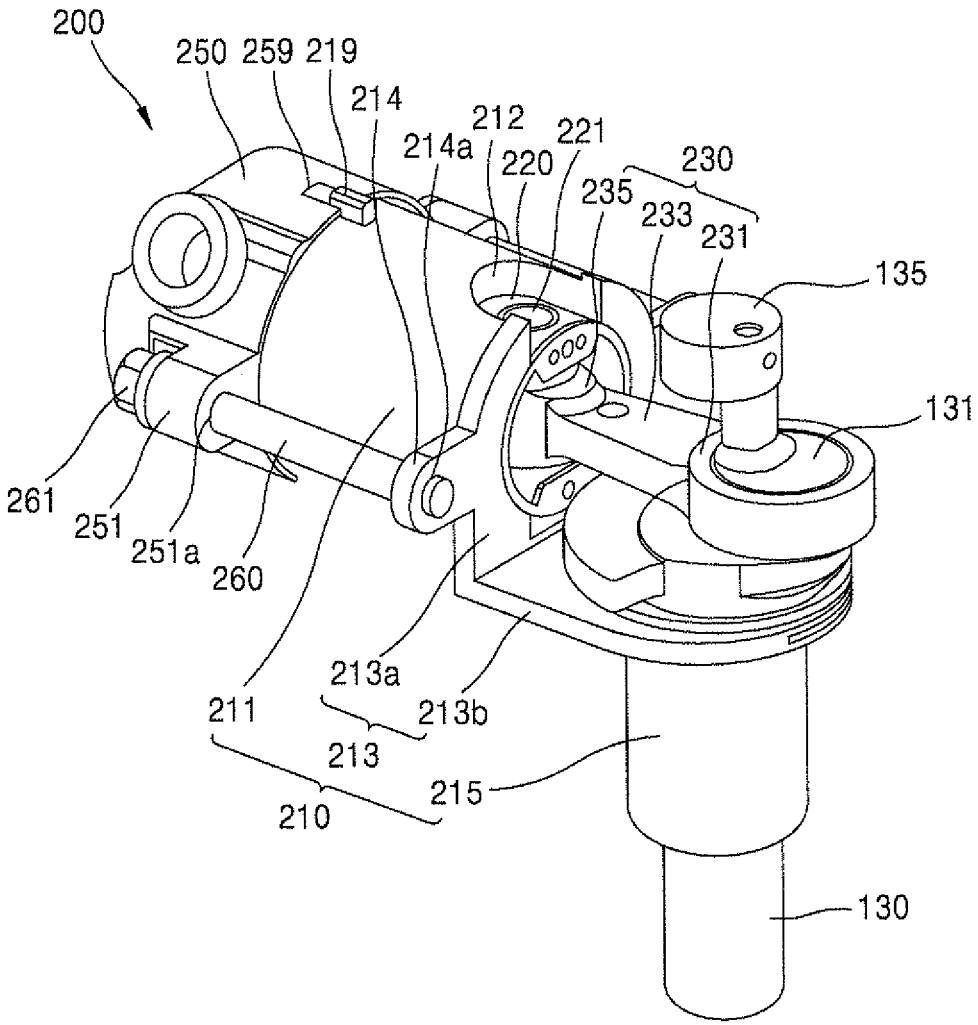
FIGS. 2 and 3 are schematic perspective views illustrating a configuration of a compression portion of a reciprocating type compressor according to an embodiment.

The piston 220 may have a cylindrical shape having a closed end, and may be rotatably coupled to a piston connecting portion 235 (see FIG. 2) of the connecting rod 230 by using a fastening pin 221 (see FIG. 2). A first end of the connecting rod 230 may be coupled to the pin portion 131 of the crank shaft 130, and a second end of the connecting rod 230 may be coupled to the piston 220 to convert a rotational force of the crank shaft 130 into a linear motion of the piston 220.

The head cover 250 may be coupled to a rear of the cylinder portion 211, and may embed a valve assembly including a suction valve and a discharge valve. The compression portion 200 may further include a suction muffler, a discharge cover, a discharge muffler, and the like.

Figure 3:
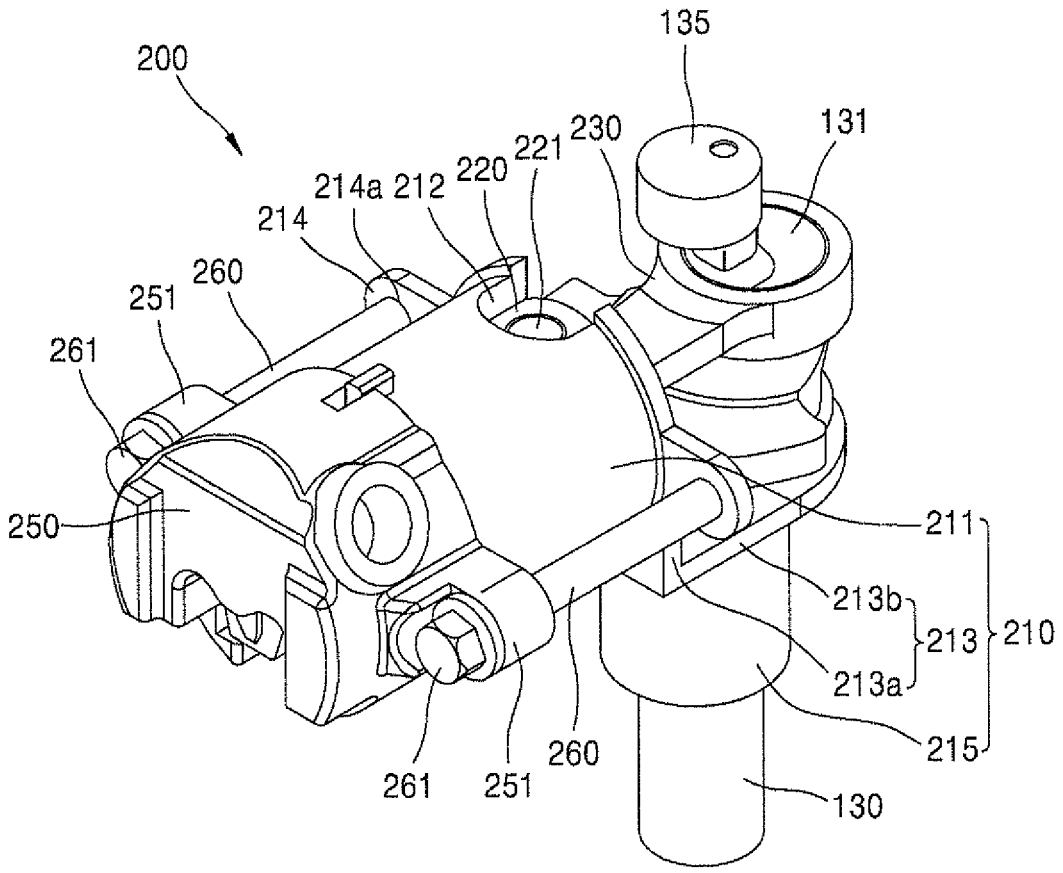
Figure 4:
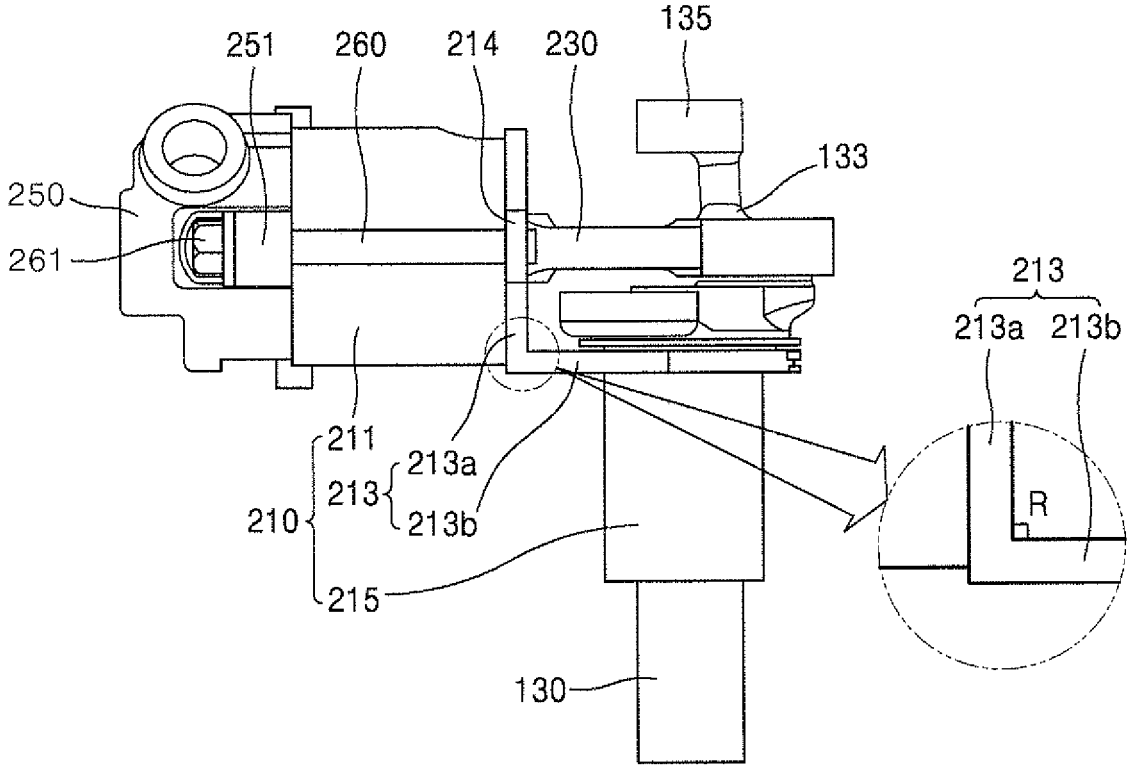
FIG. 4 is a schematic side view illustrating a configuration of a compression portion of a reciprocating type compressor according to an embodiment.

FIGS. 2 and 3 are perspective views illustrating a configuration of a compression portion of a reciprocating type compressor according to an embodiment, viewed from different directions, and FIG. 4 is a schematic side view illustrating a configuration of a compression portion of a reciprocating type compressor according to an embodiment. Referring to FIGS. 2 to 4, the reciprocating type compressor according to an embodiment of the present disclosure may include the cylinder boss integral body 210, the piston 220, the connecting rod 230, and the head cover 250.

The crank shaft 130 may be coupled to the rotor 120 (see FIG. 1) of the motor portion 100 (see FIG. 1) to transfer a rotational force. The piston 220 may compress the refrigerant while linearly moving within the compression portion 200 of the cylinder 211. The connecting rod 230 may be connected between the crank shaft 130 and the piston 220 to convert a rotational force of the crank shaft 130 into a linear motion of the piston 220.

For example, the first end of the connecting rod 230 may be coupled to the pin portion 131 of the crank shaft 130, and the second end of the connecting rod 230 may be coupled to the piston 220 through insertion of the fastening pin 221.

Specifically, the connecting rod 230 may include a shaft connecting portion (or first end) 231 connected to the pin portion 131, a piston connecting portion (or second end) 235 connected to the piston 220, and a rod portion (or body) 233 connected between the shaft connecting portion 231 and the piston connecting portion 235.

The shaft connecting portion 231 may have an annular shape into which the pin portion 131 may be inserted. The piston connecting portion 235 may be located at an opposite side of the shaft connecting portion 231. The piston connecting portion 235 may have an annular shape so as to be connected to the piston 220 by using the fastening pin 221.

The crank shaft 130 may be coupled to the shaft connecting portion 231 of the connecting rod 230 by way of the pin portion 131. The crank shaft 130 may further include a cylindrical upper end 135 that extends above the pin portion 131. The upper end 135 of the crank shaft 130 may be inserted into and supported by a second mounting hole 321 (see FIG. 7) of an upper sheet metal frame 320 (see FIG. 7).

The cylinder boss integral body 210 may have an integral structure such that the cylinder portion 211 and the boss portion 215 that encloses the crank shaft 130 are integrally formed at right angles to each other. The cylinder boss integral body 210 may include the cylinder portion 211, the boss portion 215, and a right angle connecting portion or frame 213.

The cylinder portion 211 may provide the compression space at an interior thereof so that the piston 220 compresses the refrigerant while linearly moving, and may have a cylindrical shape whose front and rear portions are opened. The boss portion 215 may be connected to the cylinder portion 211 and may be perpendicular to the cylinder portion 211. The boss portion 215 may have a tubular shape so as to enclose an outer circumferential surface of the crank shaft 130.

The right angle connecting portion 213 may be a rigid member that connects the cylinder portion 211 and the boss portion 215 in an "L" shape so that they are at right angles to each other. The right angle connecting portion 213 may make it possible to maintain perpendicularity between the cylinder portion 211 and the boss portion 215.

That is, the cylinder portion 211, the right angle connecting portion 213, and the boss portion 215 may be formed as a single body by using the same material so that the perpendicularity between the cylinder portion 211 and the boss portion 215 is not deformed, thereby preventing performance degradation resulting from deformation of the perpendicularity. For example, the right angle connecting portion 213 may include a first connecting frame 213*a* formed at a side of the cylinder portion 211 and a second connecting frame portion 213*b* formed at a side of the boss portion 215.

The first connecting frame 213*a* may extend in a cross-sectional direction of the cylinder portion 211 to protrude in a plate shape. The second connecting frame 213*b* may extend in a cross-sectional direction of the boss portion 215 to protrude in a plate shape so that the second connecting frame 213*b* is at right angles to the first connecting frame 213*a*.

The first connecting frame 213*a* and the second connecting frame 213*b* may be formed as an integral structure so as to maintain the perpendicularity. Referring to FIG. 4, it can be seen that a right angle (that is, R=90 degrees) between the first connecting frame 213*a* and the second connecting frame 213*b* is maintained, thereby maintaining the perpendicularity between the cylinder portion 211 and the boss portion 215.

In the cylinder boss integral body 210, the cylinder portion 211 may include a pin fastening hole 212 at a location close to the first connecting frame 213*a*.

The pin fastening hole 212 may be a hole formed in an arc shape at an upper end of the cylinder portion 211. That is, the pin fastening hole 212 may be a space portion of the cylinder portion 211 that is cut out in order to fasten the fastening pin 221 between the piston connecting portion 235 and the piston 220. Accordingly, the pin fastening hole 212 may be formed by opening an upper end of one side of the cylinder portion 211 to correspond to a location where the connecting rod 230 and the piston 220 are fastened.

The head cover 250 including the valve assembly may be coupled to a side of the cylinder portion opposite to where the first connecting frame 213*a* protrudes in the cylinder portion 211, that is, a rear end of the cylinder portion 211. The head cover 250 and the cylinder portion 211 may be fastened by at least two fastening bolts 260.

When the head cover 250 and the cylinder portion 211 are coupled to each other only by one fastening bolt 260, the cylinder portion 211 may not be firmly fixed, and a repetitive operation of the piston 220 may cause deformation of the cylinder portion 211. Therefore, it may be possible to maintain a firmly coupled state between the head cover 250 and the cylinder portion 211 by fastening a pair of fastening bolts 260 symmetrically with respect to each other.

Specifically, the head cover 250 may protrude outward, and may include at least two fastening projections 251, each having a first screw hole 251*a*. The first connecting frame 213*a* of the cylinder boss integral body 210 may protrude outward to face the at least two fastening projections 251, and may include at least two fastening tabs 214, each having a second screw hole 214*a* corresponding to each respective first screw hole 251*a*.

The at least two fastening bolts 260 may be screw-fastened by sequentially passing through the first screw hole 251*a* and the second screw hole 214*a*, thereby maintaining a firmly coupled state between the head cover 250 and the cylinder portion 211. An anti-loosening washer may be further provided between a bolt head 261 and the fastening projection 251, but embodiments of the present disclosure is not limited thereto.

The head cover 250 may include a rectangular guide groove 259 that may guide a location (or direction) to be coupled to the cylinder portion 211. The cylinder portion 211 may include a rectangular guide projection 219 that is insertable through the guide groove 259.

Thus, when the cylinder portion 211 and the head cover 250 are coupled to each other, a location (or direction) where the cylinder portion 211 and the head cover 250 are coupled may be easily figured out only by inserting the guide projection 219 into the guide groove 259.

Figure 5:
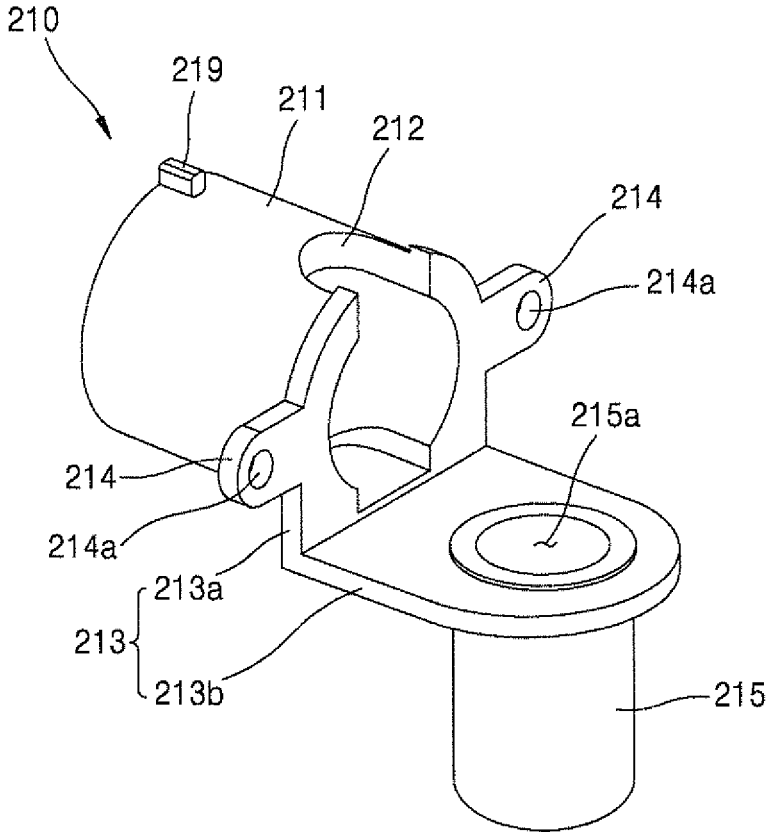
FIG. 5 is a schematic perspective view illustrating a cylinder boss integral body according to an embodiment.

FIG. 5 is a schematic perspective view illustrating a cylinder boss integral body according to an embodiment. Referring to FIG. 5, the cylinder boss integral body 210 may be an integral structure of the cylinder portion 211 having a cylindrical shape and the boss portion 215 that is formed at right angles to the cylinder portion 211 and may include a shaft insertion hole 215*a* into which the crank shaft 130 (see FIG. 2) is inserted.

The cylinder boss integral body 210 may further include the right angle connecting portion 213 that connects the cylinder portion 211 and the boss portion 215 so that an angle between the cylinder portion 211 and the boss portion 215 is a right angle, and the right angle connecting portion 213 may also have a integral structure, together with cylinder portion 211 and boss portion 215. The right angle connecting portion 213 may include the first connecting frame 213*a* and the second connecting frame 213*b*. Two fastening tabs 214 each having the second screw hole 214*a* may protrude outward from the first connecting frame 213*a*.

The cylinder portion 211 may include the guide projection 219, which may be inserted into the guide groove 259 (see FIG. 2) of the head cover 250 (see FIG. 2) to guide a location (or a direction) where the cylinder portion 211 and the head cover 250 are coupled. Subsequently, a structure in which the cylinder boss integral body is coupled to upper and lower sheet metal frames according to an embodiment will be described.

Figure 6:
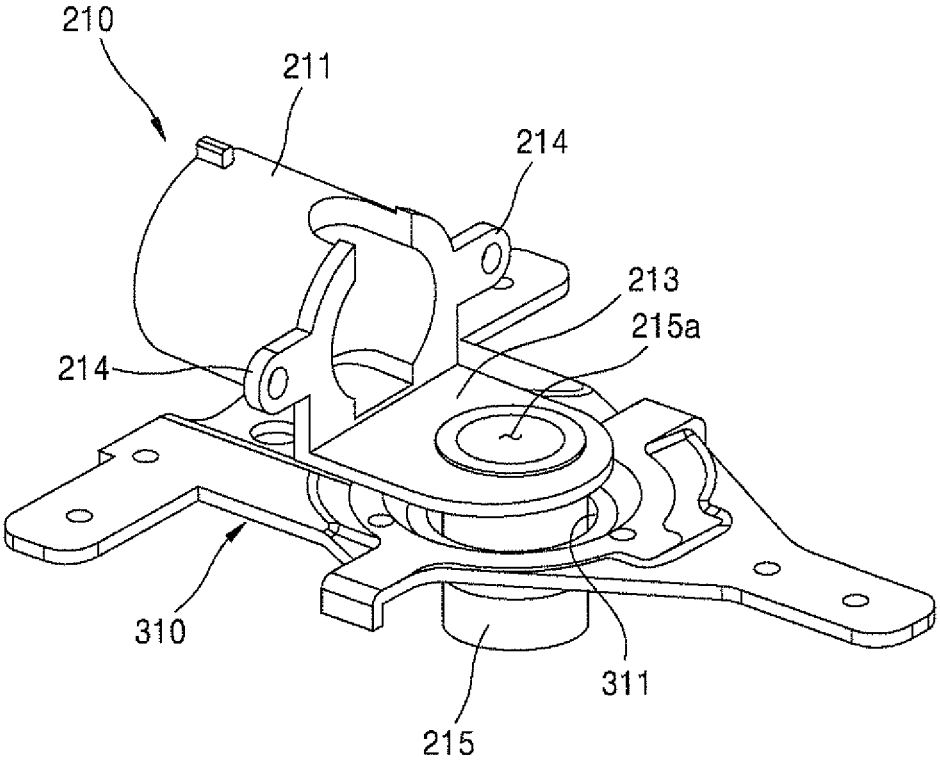
FIG. 6 illustrates a state where a cylinder boss integral body is mounted on a lower sheet metal frame according to an embodiment.
Figure 7:
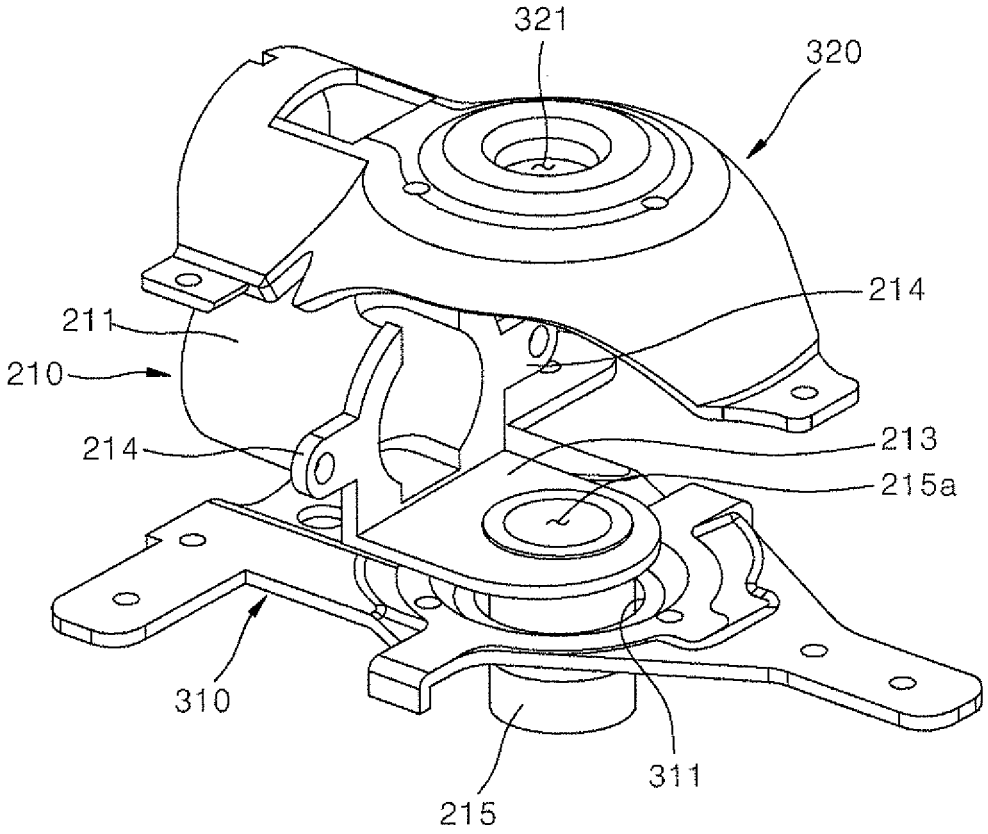
FIG. 7 illustrates a state where a cylinder boss integral body is mounted between upper and lower sheet metal frames according to an embodiment.

FIG. 6 is a view illustrating a state where a cylinder boss integral body is mounted on a lower sheet metal frame according to an embodiment, and FIG. 7 is a view illustrating a state where a cylinder boss integral body is mounted between upper and lower sheet metal frames according to an embodiment. Referring to FIG. 6, the cylinder boss integral body 210 may be mounted on a lower sheet metal frame 310 according to an embodiment.

The lower sheet metal frame 310 may include a first mounting hole 311 at an inner side into which the boss portion 215 is inserted. Thus, the cylinder boss integral body 210 having a lower portion that protrudes due to the boss portion 215 may be stably mounted on the lower sheet metal frame 310.

Referring to FIG. 7, as the boss portion 215 is inserted through the first mounting hole 311, the upper sheet metal frame 320 may be coupled so as to cover an upper portion of the cylinder boss integral body 210 which has been stably mounted on the lower plate frame 310. At this time, a second mounting hole 321 may be provided at an inner side of the upper frame 320 through a location that faces the first mounting hole 311. The second mounting hole 321 may be a hole to which an upper end 135 (see FIG. 2) of the crank shaft 130 (see FIG. 2) is coupled in a penetrating manner. The crank shaft 130 may be supported by the upper frame 320 together with the boss portion 215, so that the crank shaft 130 may be structurally stable.

As described above, according to a configuration and a function of embodiments, there may be an advantage of being able to maintain perpendicularity between the piston and crank shaft by using the cylinder boss integral body in which the cylinder including piston that linearly moves and the boss that encloses the crank shaft are integrally formed at right angles to each other. Thus, it may be possible to reduce friction and deformation of a mechanism even when an additional structure such as a ball joint is not used to improve a degree of freedom between the piston and the crank shaft, thereby contributing to a reduction in cost and performance improvement.

Further, it may be possible to directly fasten the upper and lower sheet metal frames by using the cylinder boss integral body, thereby preventing excessive fastening deformation of the sheet metal frame having a relatively thin thickness or structural weakness.

A reciprocating type compressor according to an embodiment may include a crank shaft that is coupled to a rotor of a motor portion to transfer a rotational force, a piston that compresses a refrigerant while linearly moving within a cylinder of a compression portion, a connecting rod that is connected between the crank shaft and the piston to convert the rotational force of the crank shaft into a linear motion of the piston, and a cylinder boss integral body in which the cylinder and a boss that encloses the crank shaft are integrally formed at right angles to each other. Here, the cylinder boss integral body may include a cylinder portion that provides a compression space through an interior thereof so that the piston compresses a refrigerant while linearly moving, a boss portion that is connected to the cylinder portion in a direction perpendicular to the cylinder portion and provides a shaft insertion hole into which the crank shaft is inserted along an inner center, and a right angle connecting portion that connects the cylinder portion and the boss portion so that an angle between the cylinder portion and the boss portion is a right angle.

At this time, the right angle connecting portion may include a first connecting frame that extends in a cross-sectional direction of the cylinder portion to protrude in a plate shape, and a second connecting frame that extends in a cross-sectional direction of the boss portion to protrude in a plate shape so that the second connecting frame is at right angles to the first connecting frame. Further, the cylinder portion may be coupled to a head cover including a valve assembly through an opposite side of a location where the first connecting frame protrudes.

Further, the head cover and the cylinder portion may be fastened by at least two fastening bolts. For example, the head cover may include at least two fastening projections that protrude outward and have a first screw hole; the first connecting frame may include at least two fastening tabs that protrude outward to face the at least two fastening projections and have a second screw hole corresponding to the first screw hole; and the at least two fastening bolts may be screw-fastened by sequentially passing through the first screw hole and the second screw hole.

Further, the head cover may include a guide groove that guides a location to be coupled to the cylinder portion, and the cylinder portion may include a guide projection that is insertable through the guide groove. Further, the cylinder portion may include a pin fastening hole to fasten a fastening pin between the connecting rod and the piston, and the pin fastening hole may be formed by opening an upper end of one side of the cylinder portion to correspond to a location where the connecting rod and the piston are fastened.

Further, the reciprocating type compressor according to an embodiment may include a crank shaft that is coupled to a rotor of a motor portion to transfer a rotational force, a piston that compresses a refrigerant while linearly moving within a cylinder of a compression portion, a connecting rod that is connected between the crank shaft and the piston to convert the rotational force of the crank shaft into a linear motion of the piston, and a cylinder boss integral body including a cylinder portion that provides a compression space through an interior thereof so that the piston compresses a refrigerant while linearly moving, a boss portion that is connected to the cylinder portion in a direction perpendicular to the cylinder portion and provides a shaft insertion hole into which the crank shaft is inserted along an inner center and a right angle connecting portion that connects the cylinder portion and the boss portion so that an angle between the cylinder portion and the boss portion is a right angle. The reciprocating type compressor may further include a lower sheet metal frame that includes a first mounting hole into which the boss portion is inserted, and an upper sheet metal frame that is coupled to an upper portion of the lower sheet metal frame, and includes a second mounting hole to which an upper end of the crank shaft is coupled in a penetrating manner at a location that faces the first mounting hole.

According to the embodiments, it may be possible to maintain perpendicularity between the piston and the crank shaft by using the cylinder boss integral body in which the cylinder and the boss that encloses the crank shaft are integrally formed at right angles to each other. Thus, it may be possible to reduce the friction and deformation of the mechanism even when an additional structure such as a ball joint is not used to improve a degree of freedom between the piston and the crank shaft, thereby contributing to a reduction in cost and performance improvement.

Also, according to the embodiments, it may be possible to directly fasten the upper and lower sheet metal frames by using the cylinder boss integral body, thereby preventing excessive fastening deformation of the sheet metal frame having a relatively thin thickness or structural weakness. Specific effects of the embodiments of the present disclosure in addition to the above-described effects will be described together with the following details for carrying out the embodiments of the present disclosure.

The present disclosure is described with reference to illustrative drawings, but is not limited by the embodiments described herein and accompanying drawings. It should be apparent to those skilled in the art that various changes which are not exemplified herein but are still within the spirit and scope of the present disclosure may be made. Further, it should be apparent that, although an effect from a configuration of the present disclosure is not clearly described in the embodiments of the present disclosure, any effect, which can be predicted from the corresponding configuration, is also to be acknowledged.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating type compressor, comprising:

a crank shaft that is coupled to a rotor of a motor to transfer a rotational force from the motor to the crank shaft;

a piston that compresses a refrigerant while linearly moving within a cylinder;

a connecting rod that connects the crank shaft to the piston to convert the rotational force of the crank shaft into a linear motion of the piston; and a cylinder boss integral body, the cylinder boss integral body comprising:

the cylinder that provides a compression space at an interior thereof to allow the piston to compress the refrigerant while linearly moving;

a boss that is connected to the cylinder in a direction perpendicular to the cylinder and includes a shaft insertion hole into which the crank shaft is inserted; and a right angle connecting frame that connects the cylinder and the boss so that an angle between an axis of the cylinder and an axis of the boss is a right angle, wherein the reciprocating type compressor further comprises:

a lower frame that includes a first mounting hole into which the boss is inserted; and an upper frame that is coupled to an upper portion of the lower frame, and includes a second mounting hole to which an upper end of the crank shaft is coupled in a penetrating manner at a location that faces the first mounting hole, wherein a head cover is coupled to an end of the cylinder opposite the boss, wherein the head cover includes a valve assembly and a guide groove configured to guide the cylinder, wherein the cylinder includes a guide projection configured to be inserted into the guide groove, wherein the cylinder has cylindrical shape, wherein the boss has a tubular shape so as to enclose an outer circumferential surface of the crank shaft, wherein the right angle connecting frame comprises:

a first connecting frame that extends in a direction perpendicular to a central longitudinal axis of the cylinder and has a plate shape; and a second connecting frame that extends in a direction perpendicular to a central longitudinal axis of the boss and has a plate shape so that the second connecting frame extends at a right angle to the first connecting frame, wherein the head cover and the cylinder are fastened to each other by at least two fastening bolts, wherein the head cover includes at least two fastening projections that protrude radially outward, each fastening projection having a first screw hole, wherein the first connecting frame includes at least two fastening tabs that protrude radially outward to face the at least two fastening projections, each fastening tab having a second screw hole corresponding to the first screw hole, wherein the at least two fastening bolts are screw-fastened by sequentially passing through each of the first screw hole and the second screw hole, respectively, wherein the cylindrical boss integral body is mounted on the lower frame, wherein the upper frame is coupled to the lower frame to cover the cylindrical boss integral body, and wherein the boss, the upper frame, and the lower frame support the crank shaft.

2. The reciprocating type compressor of claim 1, wherein the lower frame and the upper frame are sheet metal.

3. The reciprocating type compressor of claim 1, wherein the cylinder includes a pin fastening hole that allows a fastening pin to be inserted between the connecting rod and the piston, and wherein the pin fastening hole is formed by opening an upper end of one side of the cylinder to correspond to a location where the connecting rod and the piston are fastened.

4. The reciprocating type compressor of claim 1, wherein the connecting rod includes a shaft connecting portion provided at a first end of the connecting rod, a piston connecting portion provided at a second end of the connecting rod, and a rod portion that connects the shaft connecting portion to the piston connecting portion.

5. The reciprocating type compressor of claim 4, wherein the crank shaft includes a pin portion rotatably coupled to the shaft connecting portion of the connecting rod.

6. The reciprocating type compressor of claim 4, wherein the piston is coupled to the piston connecting portion by a fastening pin inserted between the piston and the piston connecting portion.

* * * * *